United States Patent [19]

Parekh et al.

[11] Patent Number: 4,792,770

[45] Date of Patent: Dec. 20, 1988

[54] WAVEGUIDE DIRECTIONAL COUPLER WITH MULTIPLE COUPLED OUTPUTS

[75] Inventors: Sharad V. Parekh, Plano, Tex.; Seymour W. Shapiro, Cinnaminson; Charles E. Profera, Jr., Cherry Hill, both of N.J.

[73] Assignee: General Electric Company, East Windsor, N.J.

[21] Appl. No.: 67,324

[22] Filed: Jun. 29, 1987

[51] Int. Cl.[4] ..... H01P 5/18

[52] U.S. Cl. ..... 333/113; 333/137

[58] Field of Search ..... 333/125, 137, 113, 114; 343/772, 776, 778

[56] References Cited

U.S. PATENT DOCUMENTS

| | | | |
|---|---|---|---|
| 2,558,385 | 6/1951 | Purcell . | |
| 2,580,678 | 1/1952 | Hansen et al. | 333/113 X |
| 2,730,677 | 1/1956 | Boissinot et al. | 333/137 X |
| 3,044,026 | 7/1962 | Patterson . | |
| 3,175,171 | 3/1965 | Reindel . | |
| 3,758,879 | 9/1973 | Beguin et al. . | |
| 3,958,192 | 5/1976 | Rootsey | 333/125 |
| 4,223,283 | 9/1980 | Chan | 333/109 |

OTHER PUBLICATIONS

*Antenna Engineering Handbook*, by Jasik, published by McGraw-Hill, first edition, 1961, pp. 30–19.

*Primary Examiner*—Paul Gensler

*Attorney, Agent, or Firm*—Clement A. Berard, Jr.; William H. Meise

[57] ABSTRACT

A reduced size waveguide directional coupler assembly includes a first rectangular waveguide which is adapted to receive signal at an input port. A conductive septum parallel with a broad wall of the rectangular waveguide divides the signal into two portions flowing in first and second channels within the first waveguide. The septum may be centered between the broad walls, in which case the two signal portions and channel dimensions are the same, or the septum may be off-center, resulting in dissimilar amplitudes of the two signal portions. The coupler also includes a second waveguide. Branch waveguides or other coupling apertures open from the first channel into the second waveguide. That energy not flowing to the second waveguide from the first channel may be routed to an independent output port, or may be recombined with the energy flowing in the second channel and routed to a combined output port. The coupler may include a third waveguide coupled by branch waveguides or other coupling apertures to the second channel. That energy not coupled from the second channel to the third waveguide may be coupled to an independent output port, or may be recombined with the residual energy from the first channel at a combined output port. A load may be coupled to the septum to dissipate unbalanced power.

17 Claims, 7 Drawing Sheets

WAVEGUIDE DIRECTIONAL COUPLER WITH MULTIPLE COUPLED OUTPUTS

BACKGROUND OF THE INVENTION

This invention relates to directional couplers having plural, independent coupled outputs.

Waveguide is a form of transmission line in the form of a hollow pipe through which electromagnetic energy can propagate. Waveguide is advantageous because of its relatively low loss and high power-handling capbbility, and finds extensive use at microwave (3–30 GHz) and millimeter-wave frequencies (30–300 GHz). Waveguide can be used at frequencies lower than microwave frequencies, but tends to be relatively large and heavy, so that other forms of transmission line may be preferable.

In electromagnetic communication systems, there is often a need to sample a particular proportion of energy flowing in a transmission line, and to couple the sample into another transmission line. This may be accomplished in many ways, but a particularly advantageous arrangement is known as a directional coupler. A directional coupler includes two coupled transmission lines arranged so that energy flowing in one direction in one transmission line couples so as to flow in a preferred direction in the other transmission line. Reversal of the direction of energy flow in one transmission line results in a reversal of the direction of flow in the other transmission line.

In rectangular waveguide energy propagation systems, a directional coupler may be implemented by paralleling two rectangular waveguides with a common broad wall, and forming coupling apertures in the common wall in such a fashion that signal flowing through the coupling apertures adds in-phase in one direction and cancels in the other direction. The conditions under which this occurs are well known in the art and no further description is required. Another type of waveguide directional coupler includes two parallel, spaced-apart waveguides with branch waveguides extending therebetween. Such a directional coupler is described in U.S. patent application Ser. No. 842,773, filed Mar. 21, 1986, in the name of Praba et al, now U.S. Pat. No. 4,679,011. In some embodiments, the Praba et al. arrangement uses waveguides having cross-sectional dimensions which have reduced height compared with standard waveguide, for increased bandwidth. Tapered adaptors allow coupling of the reduced-height waveguides of the directional coupler to standard waveguides.

In some systems applications, it is advantageous to use more than one directional coupler. When many directional couplers are needed, their combined physical size and weight may be disadvantageous, especially if tapered adaptors are used between couplers. It would be advantageous to reduce the overall size of arrangements of plural directional couplers.

SUMMARY OF THE INVENTION

A directional coupler includes a first waveguide and a longitudinal septum dividing the first waveguide into plural longitudinal channels at least in a coupling region. Additional waveguides are coupled by directional coupling apertures to the longitudinal channels of the first waveguide. In some embodiments, the position of the longitudinal septum within the first waveguide changes along its length.

DESCRIPTION OF THE INVENTION

Figure 1A:
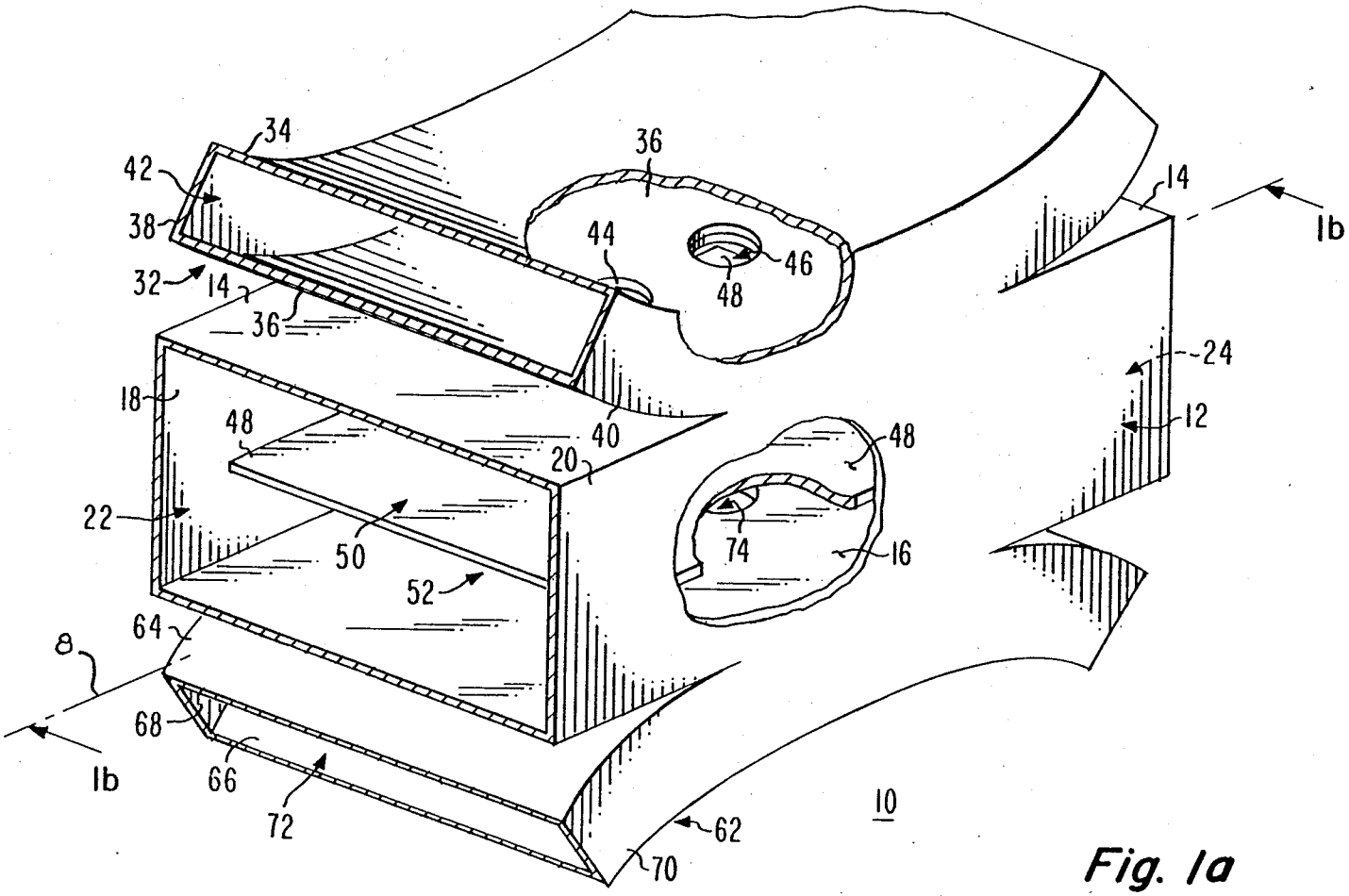
FIG. 1*a* is a perspective or isometric view of a waveguide directional coupler according to the invention, partially cut away to show interior details of the coupling apertures in common walls.

FIG. 1*a* is a perspective or isometric view of a portion of a waveguide system including a directional coupler 10 according to the invention. In FIG. 1*a*, a first waveguide 12 includes a conductive broad upper wall 14 and a conductive broad lower wall 16 spaced apart by conductive narrow side walls 18 and 20. Walls 14–20 define a hollow rectangular waveguide centered on a longitudinal axis 8. At the left of FIG. 1*a*, the opening defined by walls 14–20 defines a waveguide port 22. A similar opening, not visible in FIG. 1*a*, located at the other end of the illustrated portion of waveguide 12, defines a further port 24. Port 24 and its relation to the remainder of the structure may be seen in the cross-section of FIG. 1*b*, which is a view looking in the direction of arrows 1*b*—1*b* in FIG. 1*a*. Ports 22 and 24 are adapted for being connected to feed waveguides, as well known in the art. In this context, the term "feed" waveguide encompasses both sources and sinks of energy. Waveguide ports 22 and 24 may be fitted with coupling flanges when directional coupler 10 is fabricated apart from the waveguide system of which it is a part.

A second waveguide 32 includes conductive broad walls 34 and 36 spaced apart by narrow conductive walls 38 and 40. Waveguide 32 has a straight longitudinal axis (not illustrated) in a coupling region described below, but is bent or curved in regions remote from the coupling region so that waveguide connections may be readily made. In the coupling region, lower broad wall 36 of waveguide 32 merges with upper broad wall 14 of waveguide 12. Upper broad wall 34 is partially cut away in the illustration of FIG. 1*a* to reveal details of the coupling region. In the coupling region, two coupling apertures 44 and 46 are formed in merged walls 14 and 36, allowing energy to be coupled between waveguides 12 and 32. Two apertures 44, 46 are illustrated for ease of illustration, but the usual coupler has more than two such apertures. The coupling region includes the region occupied by the coupling apertures and the adjacent region influencing the coupling.

Figure 1B:
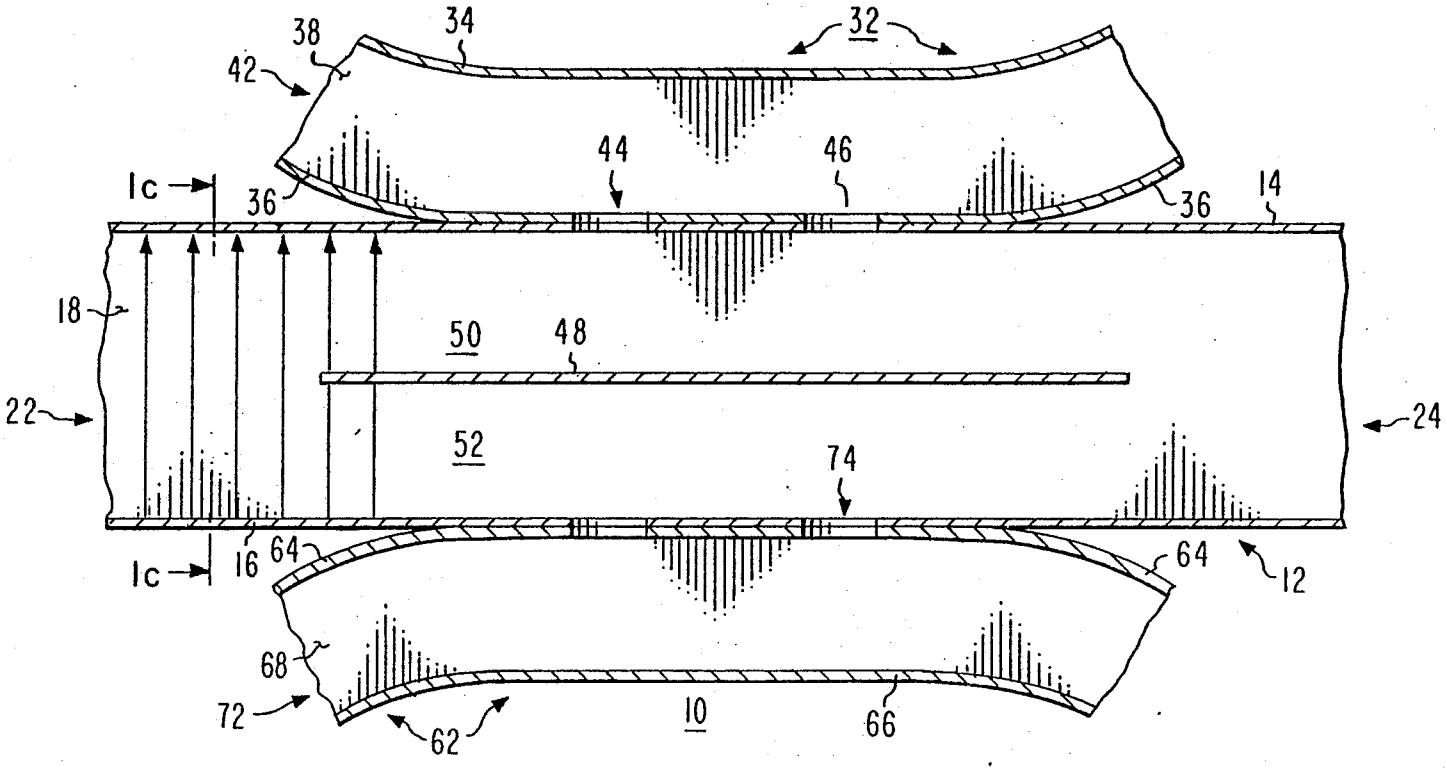
FIG. 1*b* illustrates a cross-section of the coupler of FIG. 1*a* looking in the direction of arrows 1*b*—1*b*.
Figures 1C, 1D, 1E:
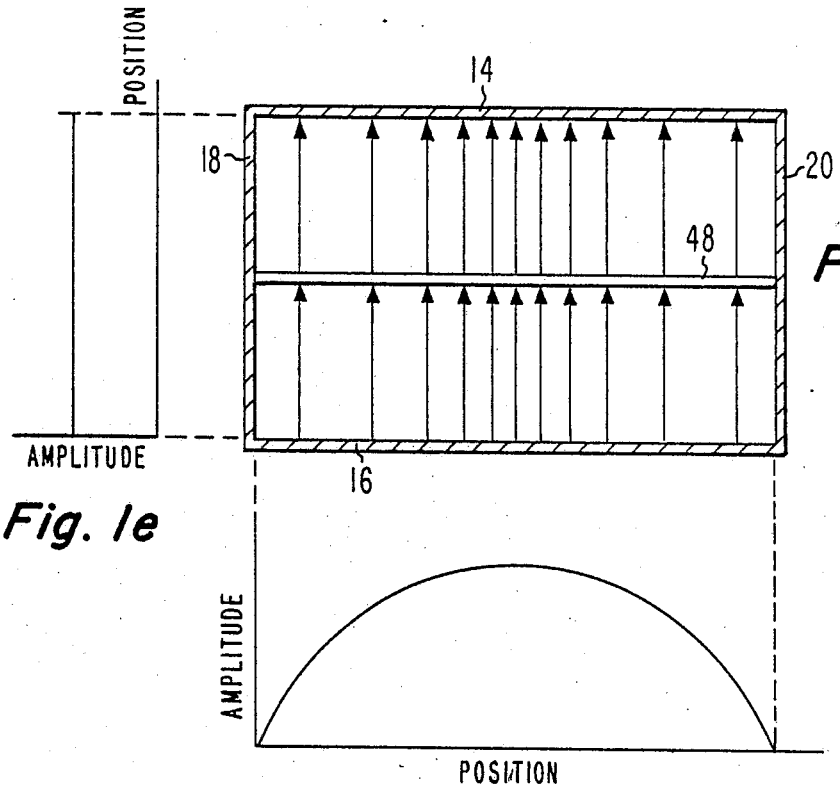
FIG. 1*c* is a view looking into a waveguide port of the coupler of FIG. 1*a*, illustrating the electric field distribution near the edge of a septum.
FIG. 1*d* is an amplitude-position plot of the electric field distribution in the H-plane.
FIG. 1*e* is an amplitude-position plot of the electric field distribution in the E-plane.

As so far described, directional coupler 10 is similar to the prior art. Waveguide 12 further includes a horizontally disposed thin conductive septum 48 lying parallel to and equidistant from broad walls 14 and 16 near the coupling region. Septum 48 makes conductive contact along two of its edges with narrow walls 18 and 20, and does not extend as far as ports 22 or 24. In the coupling region, septum 48 divides waveguide 12 into an upper channel 50 with a rectangular cross-section and a similar lower channel 52. Electromagnetic energy flowing into port 22 of waveguide 22 in a $TE_{1,0}$ mode (the usual propagating mode) is not greatly perturbed by the presence of septum 48, but the energy (or the time rate of energy, which is power) divides between the upper and lower channels 50 and 52 according to the ratio of their cross-sectional areas. FIG. 1*c* is a cross-section of waveguide 12 in a region occupied by septum 48, looking in the direction of arrows 1*c*—1*c* of FIG. 1*b*, illustrating an instantaneous electric field distribution by arrows. The density of the arrows is maximum near the center of the waveguide and zero adjaeent the conductive side walls 18 and 20. FIG. 1*d* is a plot of the electric field amplitude distribution in the H direction as a function of position within the waveguide. FIG. 1*e* is a plot of the electric field amplitude distributrion in the E direction. Since septum 48 is equidistant from broad walls 14 and 16, the cross-sectional area of channel 50 equals that of channel 52, and the power entering port 22 divides equally between the upper and lower channels. Thus, the power flow in upper channel 50 is −3.0ldB relative to the power entering port 22, and the relative power flow in lower channel 52 is also −3.0ldB.

Referring again to FIGS. 1*a* and 1*b*, broad walls 34 and 36 of waveguide 32 are as wide as broad walls 14 and 16 of waveguide 12, but narrow walls 38 and 40 are only half as wide as narrow walls 18 and 20. Consequently, the area of near port 42 defined by walls 34–40 of waveguide 32 is one half the area of port 22 of waveguide 12. Thus, the cross-sectional area of waveguide 32 equals the cross-sectional area of upper channel 50 to which it is coupled. This relationship is not mandatory in order to achieve directional coupling, but equal size waveguides are almost universally used because of considerations of operating frequency of the waveguide, and for ease of calculations relating to coupling.

In operation, that portion of the power entering port 12 which enters upper channel 50 propagates along channel 50 to the coupling apertures 44, 46. The coupling apertures couple a sample of the power from upper channel 50 to waveguide 32 in a directional manner. While the description of the operation is couched in terms of coupling from waveguide 12 and channel 50 to waveguide 32, those skilled in the art realize that the reciprocal nature of passive-linear devices such as couplers makes the description applicable to coupling in any direction. That portion of the power flowing in channel 50 which is not coupled to waveguide 32 passes the coupling apertures and, when it reaches the far end of septum 48 (the right end as illustrated in the cross-section of FIG. 1*b*), recombines with power flowing in lower channel 52 to exit from through output port 24. As mentioned, through output port 24 could be an input port or a coupled output port, depending upon the external connections to coupler 10.

Coupler 10 includes a further waveguide 62 which has a conductive broad upper wall 64 and a conductive broad lower wall 66 spaced apart by conductive side walls 68 and 70. The dimensions of waveguide 62 are similar to those of waveguide 32. A port 72 of waveguide 62 is visible at the near end of coupler 10 in FIG. 1*a*. Upper broad wall 64 of waveguide 62 merges with lower broad wall 16 of waveguide 12 in the coupling region. A portion of side wall 20 of waveguide 12 and a portion of septum 48 are cut away as illustrated in FIG. 1*a* to provide a view of one of the apertures 74 which provides coupling between lower channel 52 and waveguide 62.

In operation, that portion of the power entering port 22 of waveguide 12 which is divided into lower channel 52 is partially coupled to waveguide 62 in a directional manner by coupling apertures including aperture 74. That portion of the power flowing in lower channel 52 which is not coupled to waveguide 62 is remaining power, which proceeds past the coupling apertures and, when it reaches the output end of septum 48 (the right end of septum 48 in FIG. 1*b*), recombines with the power arriving from upper channel 50. The combined power exits from output port 24.

The arrangement of coupler 10, therefore, includes standard size input and output ports, inherent transitions between standard-size waveguide and half-height waveguide in the coupling region for broader coupler bandwidth, and two pairs of coupled ports. This is much more compact and is therefore potentially lighter in weight than a cascade of two conventional couplers, with or without tapered waveguide transitions.

The operation of low-loss directional couplers such as coupler 10 of FIG. 1 may be perturbed if the loads to which they are coupled are mismatched. A mismatched load causes power reflections which reenter the coupler by way of a port which was designed as an output port. Such reflections, reentering coupler 10 by way of output port 24, for example, are power-divided by septum 48, and a portion is coupled by way of the upper and lower coupling apertures, to dissipative loads (not illustrated) coupled to ports 42 and 72, respectively. However, not all the reflected power is coupled to the dissipative loads, and a portion proceeds past the coupling regions toward input port 22. When the reflected power reaches the input end of the septum 48 (the left end as illustrated in FIG. 1*b* for the described external connections), a further reflection may occur if the power in the upper and lower channels is not equal. This re-reflection perturbs the coupling. The reflection due to mismatched power in the upper and lower channels may be avoided by a transition to a coaxial-like structure in conjunction with a matched termination, as described in conjunction with FIG. 5.

Figure 2:
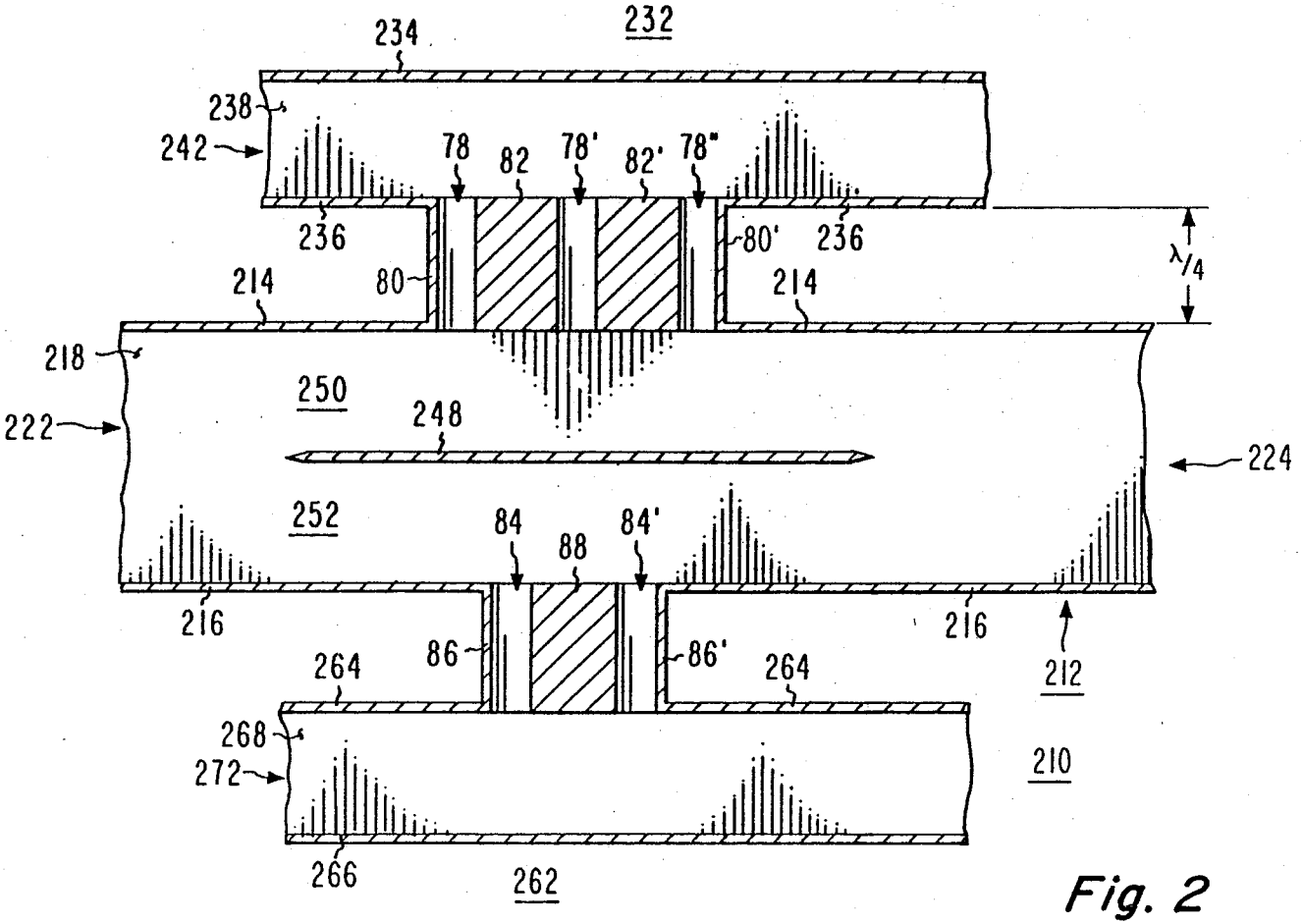
FIG. 2 illustrates a cross-section of a directional coupler according to the invention in which the coupling is provided by branch waveguides and in which the coupling from each side is equal.

FIG. 2 is a cross-section similar to that of FIG. 1*b* of a branch waveguide directional coupler. In the arrangement of FIG. 2, elements corresponding to those of FIG. 1 are designated by the same reference numeral, but in the 200 series. In FIG. 2, the upper broad wall 214 of waveguide 212 does not merge with lower broad wall 236 of waveguide 232, and the lower broad wall 216 of waveguide 212 does not merge with upper broad wall 264 of waveguide 262 in the coupling region. Instead, coupling is accomplished by a plurality of branch waveguides. Coupling between channel 250 and waveguide 232 is accomplished by three branch waveguides 78, 78' and 78", which are defined by conductive walls 80, 80' together with conductive blocks 82, 82'. Such blocks are described in the aforementioned Praba et al. patent.

Similarly, coupling between lower channel 252 of waveguide 212 and waveguide 262 is provided by a pair of branch waveguides 84, 84', defined by conductive walls 86, 86' and a conductive block 88. As is known to those 'skilled in the art, the branch waveguides have lengths (the dimension in the direction of energy propagation) of about one quarter wavelength ($\lambda/4$) at a frequency within the operating frequency band, and are spaced apart by about $\lambda/4$ to provide directional coupling. The number of branch waveguides does not determine the amount of coupling or coupling factor, but can affect the bandwidth. The amount of coupling is established by the heights of the branch waveguides (dimension between broad walls) relative to the heights of the waveguides being coupled. Thus, the amount of coupling provided by the three branch waveguides 78, 78' and 78" may be equal to the amount of coupling provided by the pair of branch waveguides 84, 84'. Thls is described in more detail in the aforementioned Praba et al. application.

For simplicity, it will often be desired to provide coupling from the upper and lower channels by the same number of branch waveguides, but this is not strictly necessary, so long as the coupling is the same at the operating frequency or over the operating frequency bandwidth, or at least remains near the design value over the frequency range of interest.

As an example of the coupling which may be provided by the arrangement of FIG. 2, assume that the power coupled from channel 250 to waveguide 232 by branch waveguides 78, 78', and 78" is $\frac{2}{3}$ (−1.76dB) relative to the power arriving at the coupling region by way of channel 250, and that the coupling from channel 252 to waveguide 262 relative to the input to channel 252 is also −1.76dB. Because of the central location of septum 248 on coupler 210 of FIG. 2, the power input to port 222 of waveguide 212 is split evenly into equal halves in channels 250 and 252 as mentioned above. With these values, a normalized input power of 1 at port 222 divides to a value of 0.5 (−3.0ldB) upon entering each of channels 250 and 252. The relative power coupled to each of waveguides 232 and 262 is the sum of −3.0ldB and −1.76dB, which equals −4.77dB. The remaining power in either channel 250 or 252 after the coupling or downstream of the coupling apertures is $\frac{1}{2}-\frac{1}{3}=1/6$. Thus, 1/6 of the total input power which entered port 222 travels toward output port 224 of waveguide 212 in each of channels 250, 252. At the right end of septum 248 in FIG. 2, the powers add to produce a total of $\frac{2}{3}$ or $\frac{1}{3}$ of the input power, corresponding to −4.77dB. The lengths and heights of channels 250 and 252 should be kept substantially equal to prevent significant relative phase shifts and reflections between the recombining energy, which might result in destructive interference, reflections, losses and generally poor operation. Thus, the arrangement of coupler 210 can provide −4.77dB (corresponding to one-third of the input power) from output port 224, and from waveguides 232 and 262.

Figure 3:
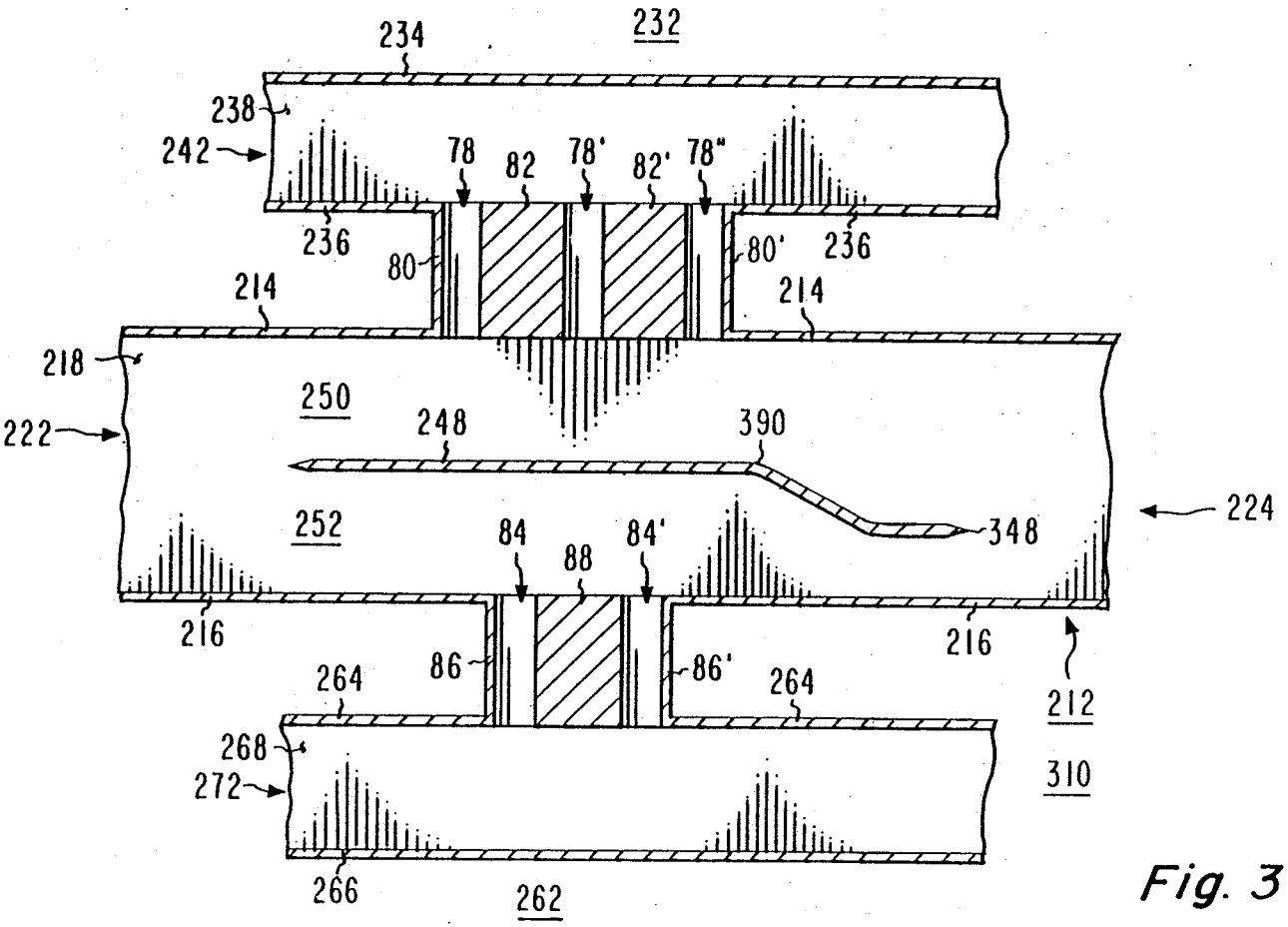
FIG. 3 illustrates a cross-section of a directional coupler according to the invention in which the coupling from each side is unequal and the septum position is altered.

The arrangement of FIG. 3 is similar to that of FIG. 2, and corresponding elements are designated by the same reference numbers. In FIG. 3, coupler 310 has branch waveguides 78, 78' and 78" which are dimensioned to provide a coupling factor relative to power flowing in channel 250 which is different than the coupling factor between channel 252 and waveguide 262. A value of −10dB (10:1) has been arbitrarily assumed for purposes of explanation. Branch waveguides 84, 84' are dimensioned for coupling of −1.76dB as in FIG. 2. The power flowing toward the right end of septum 248 and toward port 224 in channel 252 is 1/6 of the power input to port 222, also as in FIG. 2. However, since less power is being coupled from channel 250 to waveguide 232 in the arrangement of FIG. 3 than in FIG. 2, more power remains in channel 250 and is available for recombination with the remaining power in channel 252. The amount of remaining power in channel 250 is $\frac{1}{2}-1/20$, which corresponds to 0.45 of the input power. Thus, 0.45 of the input power remains in channel 250 after coupling to waveguide 232, and 0.167 of the input power remains in channel 252 after coupling to waveguide 262. In order for these disparate powers to combine, the right end 348 of septum 248, where the recombination takes place, must be positioned between walls 214 and 216 in a manner which depends upon the ratio of the powers in the channels. In the above example, the remaining power in channel 250 is 0.45 of the input power, and the remaining power in channel 252 is 0.167 of the input power. The sum of 0.45 and 0.167 is 0.617. The position of end 348 of septum 248 must be 0.45/0.617 of the way from wall 214 to wall 216, or 0.167/0.45 of the total separation between walls 214 and 216, as measured from wall 216. This is the same dimensioning which if power were entering coupler 310 from port 224, would divide the power in the channels in the desired ratio. A gradual positional taper extends from a point 390 on septum 248, outside the coupling region, to end 348.

Figure 4:
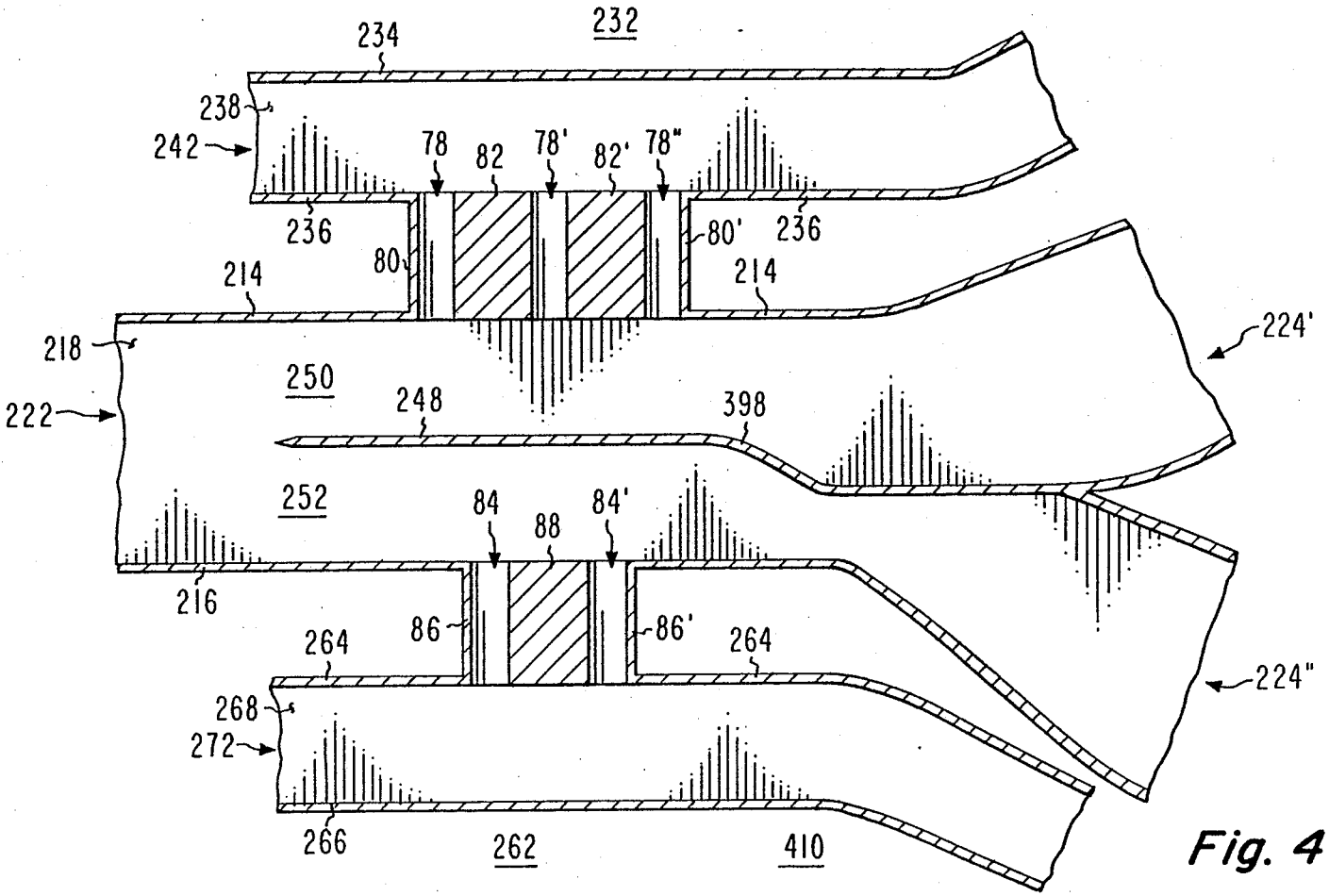
FIG. 4 is a cross-section similar to FIG. 3 of a directional coupler in which additional output ports are available.

The arrangement of FIG. 4 is a directional coupler 410 with additional output ports. The arrangement of FIG. 4 is similar to FIG. 3, and corresponding elements are identified by the same reference numbers. In FIG. 4, the remaining powers flowing in channels 250 and 252 are not recombined, but are instead routed by way of tapered transitions to independent waveguide output ports 224' and 224".

FIG. 5 illustrates a portion of a waveguide 510 including upper and lower wall 514 and 516, and side walls 518 and 520. A septum 548 extends all the way from wall 518 to wall 516 over a portion of the illustrated waveguide. The illustrated portion of waveguide and septum may be used as the input or output end of the waveguide and septum of the arrangements of FIGS. 1–4.

In general, the arrangement of FIG. 5 provides a termination for that portion of the power flowing in the upper and lower channels which would be reflected due to power mismatch, by converting the waveguide mode propagation into TEM propagation in a coaxial transmission-line structure, and by providing a resistive (dissipative) termination for the power.

Figure 5A:
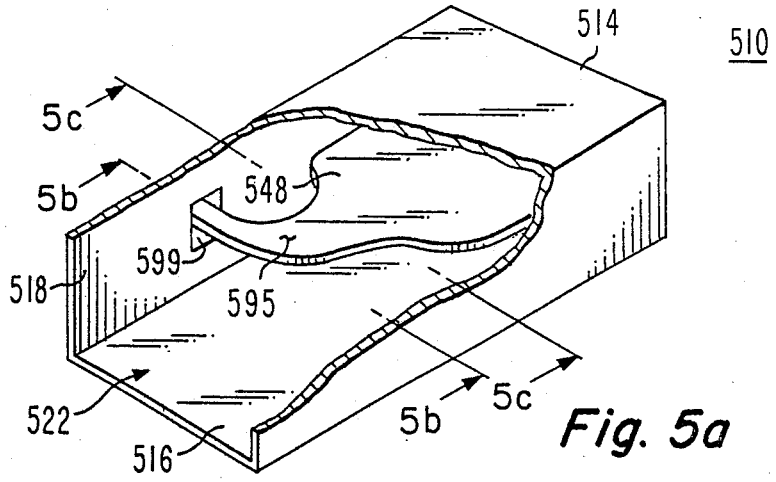
FIGS. 5*a*, 5*b* and 5*c*, referred to jointly as FIG. 5, illustrate in isometric, cut-away view a transition of the septum to a coaxial-like configuration in conjunction with a dissipative termination, and first and second cross-sections thereof, respectively.
Figure 5B:
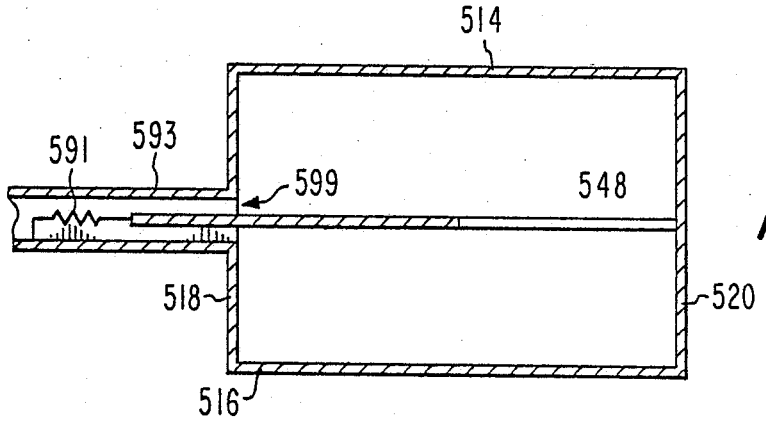
Figure 5C:
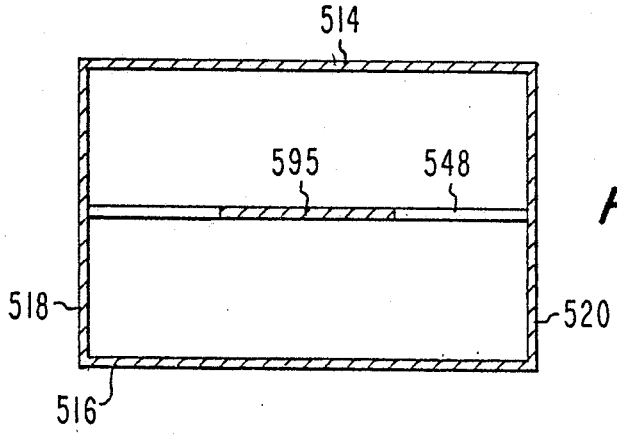

FIG. 5*a* is an isometric view, partially cut away, of the transition region. In FIG. 5*a*, port 522, which is closer to the viewer, may be the microwave energy input port. That portion of waveguide arrangement 510 remote from port 522 is coupled to directional couplers (not illustrated) such as those described in conjunction with FIGS. 1–4. An aperture 599 is formed in wall 518. Aperture 599 is illustrated as being square, but may be rectangular or round. FIG. 5*c* is a cross-section of the structure of FIG. 5*a* looking in the direction of arrows 5c—5c. At a transverse plane near the plane of FIG. 5c, septum 548 gradually narrows, and no contact is made between the edges of the septum and walls 518 and 520. This gradually narrowing portion is a tapered transition, designated 595. FIG. 5b is a cross-section of the structure of FIG. 5a looking in the direction of arrows 5b—5b. Tapered transition 525 turns near the plane of the cross-section of FIG. 5b, and the narrow end passes through aperture 599. Those skilled in the art will recognize the combination of aperture 599 and transition member 585 as corresponding to a coaxial transmission line structure. This is extended in conventional manner by an outer conductor portion 593 coupled to the edges of aperture 599. The coaxial structure is terminated in known fashion by a dissipative load illustrated as 591.

Other embodiments of the invention will be apparent to those skilled in the art. For example, branch waveguide coupling may be used on one channel of a coupler, and aperture coupling on the other side. Branch waveguide couplers with more than three branches may be used. The coupling may be made adjustable, in known manner. The coupling apertures may be covered with material transparent to energy. The waveguides need not be rectangular but may be circular, ridged or of other types. While the septum has been illustrated as centered between the broad walls in the coupling region, it may be nearer one broad side than the other, as established by the power division.

What is claimed is:

1. A directional coupler apparatus, comprising:

an elongated rectangular first waveguide including first and second conductive broad walls spaced apart by third and fourth conductive narrow walls, all centered on a longitudinal axis;

a thin, elongated conductive septum, said septum extending from said first to said second narrow walls, for dividing energy propagating in said first waveguide into at least first and second signal portions flowing in first and second channels, respectively, said septum being elongated generally in the direction of said axis and extending from a first transverse plane transverse to said axis to a second transverse plane transverse to said axis within said first waveguide;

an elongated rectangular second waveguide including first and second conductive broad walls spaced apart by third and fourth conductive narrow walls;

an elongated rectangular third waveguide including first and second conductive broad walls spaced apart by third and fourth conductive narrow walls;

first directional coupling aperture means opening into said first broad wall of said first waveguide at locations between said first and second transverse planes, and also opening into said second broad wall of said second waveguide for coupling first signal subportions of said first signal portions between said second waveguide and said first channel of said first waveguide with a first selected coupling factor;

second directional coupling aperture means opening into said second broad wall of said first waveguide at locations lying between said first and second transverse planes, and also opening into said first broad wall of said third waveguide for coupling second signal subportions of said second signal portions between said third waveguide and said second channel of said first waveguide with a second selected coupling factor, whereby a signal entering said first waveguide near said first transverse plane is divided into said first and second signal portions, flowing in said first and second channels of said first waveguide, respectively, and said first and second coupling aperture means directionally couple said first and second signal subportions, respectively, to said second and third waveguides respectively, with said first and second coupling factors, respectively, and the remaining energy of said first and second signal portions recombines at said second transverse plane of said first waveguide.

2. A coupler according to claim 1 wherein said first directional coupling aperture means comprises a plurality of branch waveguides, each having a length of approximately one quarter wavelength.

3. A coupler according to claim 2 wherein said second directional coupling aperture means also comprises a plurality of branch waveguides each having a length of approximately one quarter wavelength.

4. A coupler according to claim 1 wherein:

said second broad wall of said second waveguide merges with said first broad wall of said first waveguide to form a merged broad wall in a region lying between said first and second transverse planes; and wherein said first directional coupling aperture means comprises at least one aperture extending through said merged broad walls.

5. A coupler according to claim 1 wherein:

said spetum is spaced by a first distance from said first broad wall of said first waveguide and by a second distance from said second broad wall of said first waveguide, and said first distance is less than said second distance near said first transverse plane, whereby the magnitude of said first signal portion flowing in said first channel is in a particular ratio with the magnitude of said second signal portion flowing in said second channel near said first transverse palne;

said first and second coupling factors of said first and second directional coupling aperture means, respectively, are such as to change the ratio of the magnitude of said first signal portion flowing in said first channel to the magnitiude of said second signal portion flowing in said second channel near said second transverse plane to a second value different from said particular ratio; and said first and second distances near said second transverse plane are selected in accordance with said second ratio.

6. A coupler according to claim 1 further comprising a termination coupled to said septum, said termination comprising:

a waveguide-mode-to-TEM-mode transition; and a dissipative termination for energy flowing in said TEM mode.

7. A coupler according to claim 6 wherein said waveguide-mode-to-TEM-mode transition comprises:

a transition septum member of gradually changing width in the direction of said axis, said transition member being integral at its larger end with said septum; and an outer conductor coupled to one of said conductive narrow walls of said rectangular first waveguide and surrounding said transition septum member at its smaller end.

8. A directional coupler, comprising:

a first waveguide including a conductive tube defining a longitudinal bore and first and second ports;

a septum longitudinal dividing said bore of said first waveguide into at least two channels in a coupling region lying between said first and second ports;

a second waveguide also including a conductive tube defining a longitudinal bore lying between first and second ports; and coupling aperture means for coupling said bore of said second waveguide at a location between said first and second ports of said second waveguide to one of said channels in such a manner that a portion of signal energy applied with a given polarization to said first port of said first waveguide is preferentially coupled to said first port of said second waveguide and not to said second port of said second waveguide, and said portion of signal energy applied with said given polarization to said second port of said first waveguide is preferentailly coupled to said second port of said second waveguide and not to said first port of said second waveguide.

9. A coupler according to claim 8 wherein said first waveguide is rectangular and includes mutually orthogonal broad and narrow walls.

10. A coupler according to claim 9 wherein said septum lies generally parallel to one of said walls of said waveguide.

11. A coupler according to claim 10 wherein said septum lies generally parallel to one of said broad walls of said waveguide.

12. A coupler according to claim 8 wherein a wall of said first waveguide merges with a wall of said second waveguide to form a merged wall near said coupling region, and said coupling aperture means comprises a plurality of apertures through said merged wall.

13. A coupler according to claim 8 wherein said coupling aperture means comprises a plurality of branch waveguides extending from said second waveguide to said first waveguide at a location near said coupling region.

14. A coupler according to claim 8 wherein said two channels are connected independently to separate ports.

15. A coupleer accoring to claim 14 further comprising tapered transition means coupled to at least one of said two channels and to one of said separate ports.

16. A coupler according to claim 8 further comprising:

a third waveguide including a conductive tube defining a longitudinal bore; and further coupling aperture means coupling said bore of said third waveguide to the other of said two channels at a location near said coupling region.

17. A coupler according to claim 8 further comprising a septum-to-coaxial transition; and a dissipative load coupled to the coaxial side of sadi septum-to-coaxial transition.

* * * * *